US007615701B2

(12) United States Patent
Lin

(10) Patent No.: US 7,615,701 B2
(45) Date of Patent: Nov. 10, 2009

(54) METHOD FOR KEYING HUMAN VOICE AUDIO FREQUENCY

(75) Inventor: Wen-Hsin Lin, Taichung (TW)

(73) Assignee: Tiao-Pin Cultural Enterprise Co., Ltd., Taichung (TW)

( * ) Notice: Subject to any disclaimer, the term of this patent is extended or adjusted under 35 U.S.C. 154(b) by 19 days.

(21) Appl. No.: 12/089,179

(22) PCT Filed: Oct. 19, 2005

(86) PCT No.: PCT/CN2005/001711

§ 371 (c)(1),
(2), (4) Date: Apr. 3, 2008

(87) PCT Pub. No.: WO2007/045123

PCT Pub. Date: Apr. 26, 2007

(65) Prior Publication Data

US 2008/0216637 A1 Sep. 11, 2008

(51) Int. Cl.
*G10G 7/02* (2006.01)

(52) U.S. Cl. ..... 84/454; 84/609; 84/616; 84/619; 84/649; 84/654; 84/657

(58) Field of Classification Search ..... None
See application file for complete search history.

(56) References Cited

U.S. PATENT DOCUMENTS

| | | | | |
|---|---|---|---|---|
| 4,024,789 | A * | 5/1977 | Humphrey et al. | 84/477 R |
| 4,434,697 | A * | 3/1984 | Roses | 84/454 |
| 5,831,190 | A * | 11/1998 | Trabucco, Jr. | 84/477 R |
| 7,064,262 | B2 * | 6/2006 | Klefenz et al. | 84/616 |
| 2003/0066414 | A1 * | 4/2003 | Jameson | 84/741 |
| 2004/0060424 | A1 * | 4/2004 | Klefenz et al. | 84/616 |

FOREIGN PATENT DOCUMENTS

| | | | |
|---|---|---|---|
| CN | 1189735 | A | 8/1998 |
| JP | 5346796 | A | 12/1993 |
| JP | 2001/022364 | A | 1/2001 |

* cited by examiner

*Primary Examiner*—Marlon T Fletcher
(74) *Attorney, Agent, or Firm*—Egbert Law Offices PLLC

(57) ABSTRACT

A method for keying human voice audio frequency includes the steps of setting the human factor of the singer; recording the singing of the singer; calculating the audio frequency by an audio frequency counter; recording the maximum ground frequency by the recorder; estimating a maximum fundamental audio frequency thereof by the diapason estimator; and converting the maximum fundamental audio frequency into musical terminology, the best audio frequency of the singer being determined. The method for keying human voice audio frequency is very easy and fast.

4 Claims, 2 Drawing Sheets

METHOD FOR KEYING HUMAN VOICE AUDIO FREQUENCY

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an audio tuning method, and more particularly to an improved one which could estimate the maximum audio frequency of the singers or testees, and then tune and determine the key of music suitable for their singing range.

2. Description of Related Art Including Information Disclosed Under 37 CFR 1.97 and 37 CFR 1.98

Regular music lovers are often unaware of their own suitable key or vocal range. So, they cannot sing easily or sing in tune with the instruments, when the tone of instruments or music is too high or low. On occasions with accompanying music (e.g. Karaoke, KTV), the tune of the accompanied songs is often out of tune with the key of the singer. Moreover, singers who intend to perform large operas or concerts have to repeatedly tune in cooperation with the orchestra, leading to frequent and time-consuming tests prior to performances. Besides, the audio frequency of a person may fluctuate within a certain period of time. A bigger frequency means a higher tone, and vice versa. Also, the audio frequency may change with the varying climate, mood, physical state and time as well as gender and age of the singer. So, even if the singer is well aware of vocal range, or the trial matching with the orchestra is satisfactory, deviation or mis-tuning or an undesired performance may occur due to different environments and physical conditions.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The main purpose of the present invention is to provide an audio tuning method, and more particularly to an improved method which quickly and accurately determines the audio frequency of a person, then tunes the key of music suitable for singing.

The other purpose of the present invention is to apply the claimed audio tuning method and programmed language to develop a computer-aided functional software that can be accessed and operated through an interface. Also, it can be widely applied to various electronic equipment or musical instrument or the Internet, thus shaping an audio tuning hardware.

Based upon the innovative audio tuning method of the present invention, it is possible to easily and quickly measure the optimum vocal range of the singer, accurately obtaining the key and tuning the key in line with the vocal range of the singer for easy singing.

The present invention could be used to accurately detect the audio frequency of the singer and avoid trial matching with the orchestra, or enable the singer to measure the optimum vocal range prior to formal performance, thus preventing any deviation of vocal range from the orchestra or the key of accompanied music due to varying physical conditions, climate, mood and time, and achieving the purpose of perfectly matching the singer with the orchestra or accompanied music for optimum performance.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
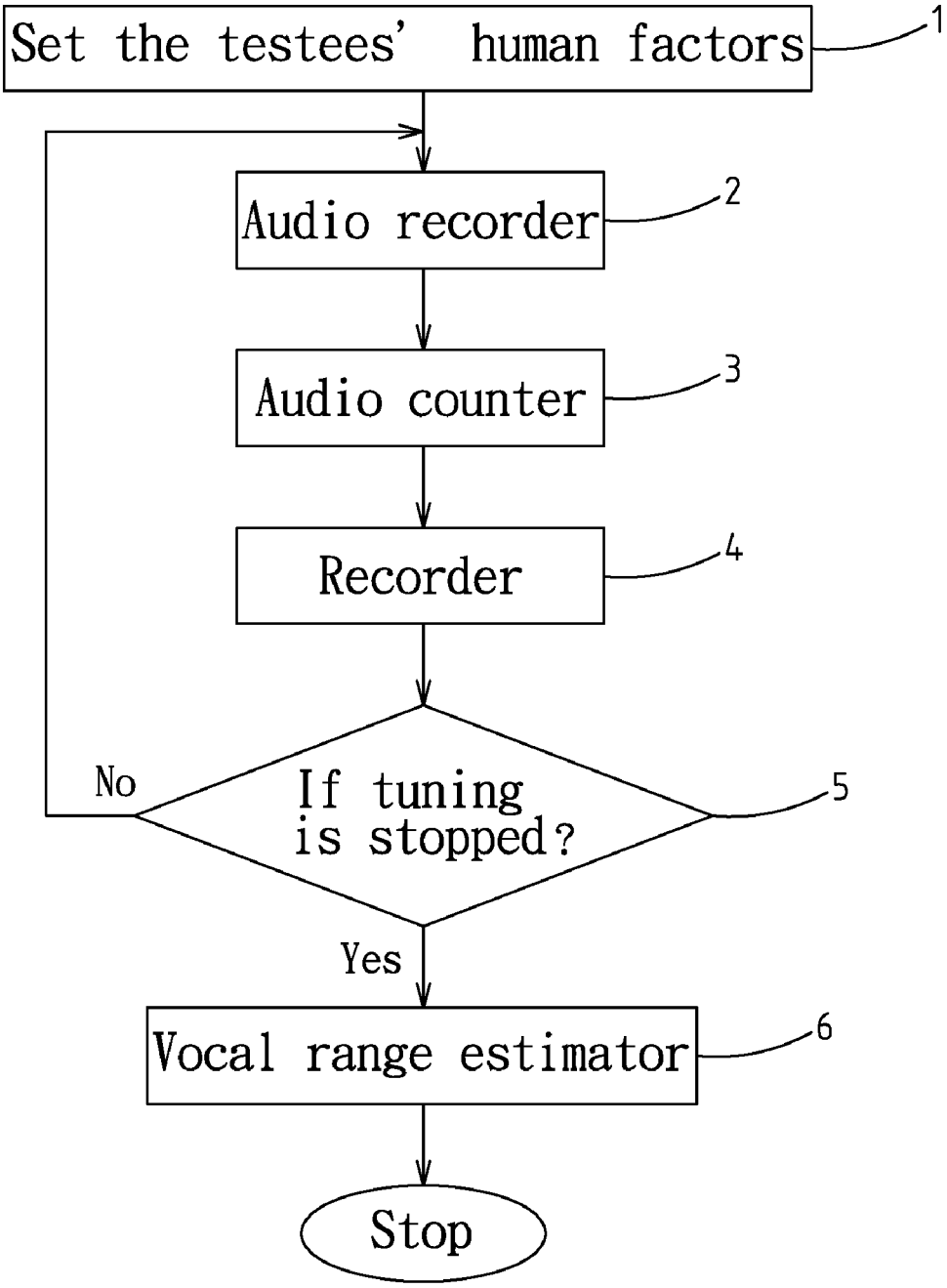
FIG. 1 shows a schematic view of a flow process chart of audio tuning method of the present invention.
Figure 2:
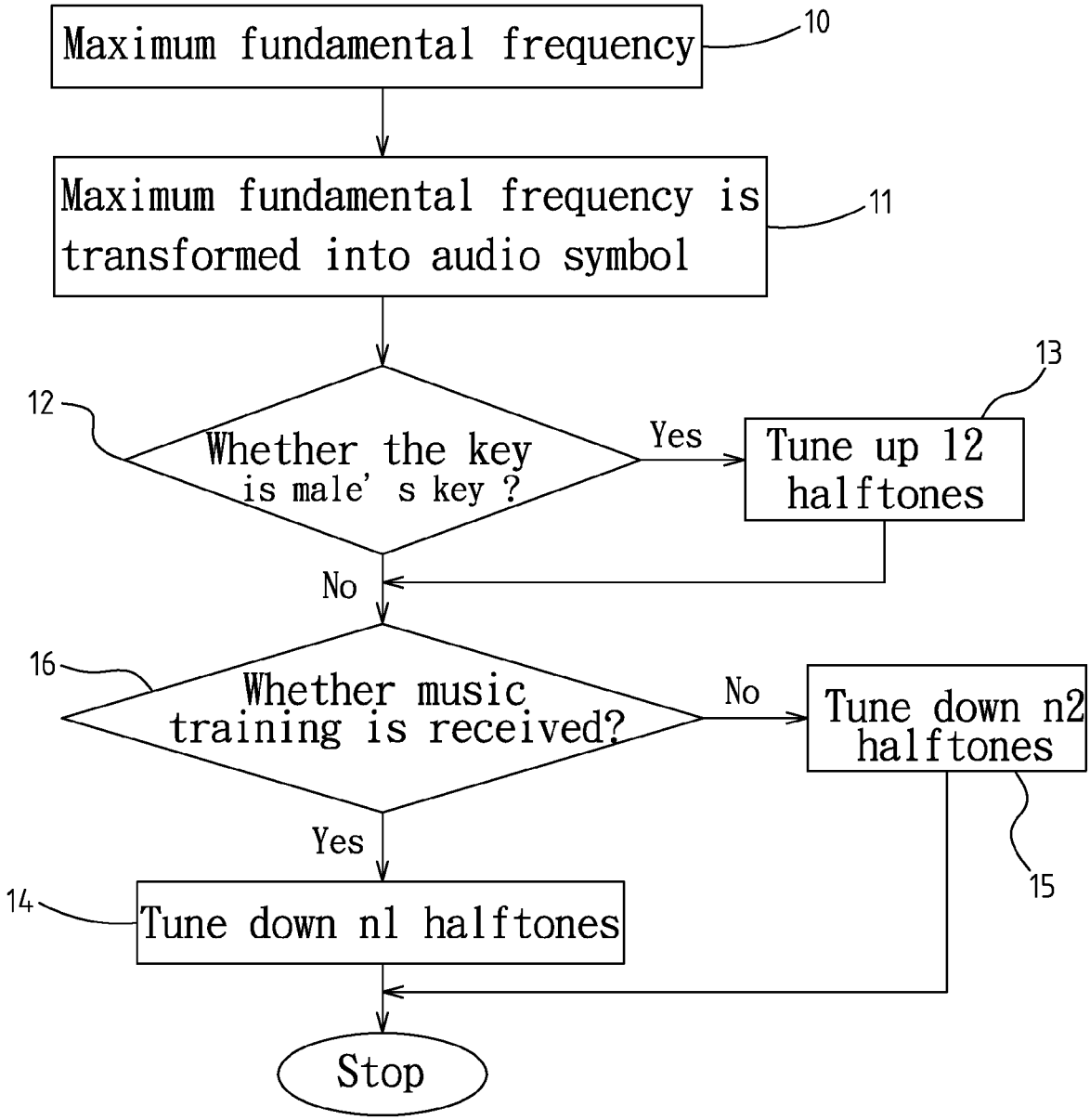
FIG. 2 shows another schematic view of a flow process chart of vocal range estimator of the present invention.

FIGS. 1-2 depict preferred embodiments of audio tuning method of the present invention. The present invention continuously detects the audio frequency and records the maximum audio frequency in the singing process, and then estimates the suitable vocal range of the singer to determine a suitable key.

Referring to FIG. 1, it is first required to set the human factors 1 of the singer, which comprises information such as musically trained or not musically trained, younger or older, female or male, if older, and girl or boy, if younger. Next, the voice of the singer is recorded continuously by an audio recorder 2, and the fundamental frequency of the voice is calculated by an audio counter 3. Then, a recorder 4 compares the fundamental frequency and records the maximum fundamental frequency. Finally, the tuning sample 5 is determined by length of the singing excerpt. If the tuning sample is complete, the maximum fundamental frequency is estimated by the vocal range estimator 6 to determine the vocal range of the singer and to complete the tuning process. Otherwise, if the tuning sample is not determined to be complete, the audio recorder 2 returns for the continued recording test.

The aforementioned audio recorder 2 is a digital recorder, which transforms audio signals into digital voice data with a duration about 0.1 second. The audio counter 3 calculates the fundamental frequency of the voice from an automatic maximum correlation function. The recorder 4 is used to record the maximum or minimum fundamental frequency. The vocal range estimator 6 provides estimates for the maximum audio frequency suitable for the singer so as to determine the key of an entire song.

The algorithm of the vocal range estimator 6 is described below:

Assuming that the maximum fundamental frequency recorded by the above-specified recorder 4 is the maximum fundamental frequency suitable for the singer, as shown in FIG. 2:

1. Transforms the maximum fundamental frequency 10 into an audio symbol 11, which is set as X.
2. For the key of male 12, let X=X+12 half-tones (one 8 degree), namely, the key is high up to 12 half-tones 13.
3. If music training 16 is received, the maximum tone suitable for singing is X—n1 half-tones, namely, the key is lowered to n1 half-tones 14.
4. If no music training 16 is received, the maximum tone suitable for singing is X—n2 half-tones, namely, the key is lower to n2 half-tones 15.

Of which, n1 and n2 have an empirical value ≧0, and obtained from actual tuning sample.

Based on above-specified steps, the preferred embodiments and efficacy of the present invention are described below:

Referring to FIG. 1, it is first required to set the "key of female or male" and "music training or not" for the singer. Then, the recording test starts by letting the singer sing a bit of a song and raising the tone gradually until the singer feels satisfied. Alternatively, the singer sings a high note and then raises the note gradually until the singer finds it difficult to raise it any more. In such a case, n1 and n2 have empirical values that may differ a little. With the audio recorder 2, the voice format is set as single-tone 16 bits, sampling frequency of 44100 Hz, and recording length of 0.1 second per time. Next, the audio counter 3 calculates the audio frequency by the following methods. Assuming the recorded voice is x(n), n=0, 1, 2 . . . , N−1, N=4410, 1. Calculate autocorrelation function rx(k), of which
   $r_x(k)=_n x(n)\ x(n-k)$, n=0, 1, 2 . . . , N−1,
   k=22, 23, 24, . . . , 674
   The range of k represents the frequency range to be detected:

44100/22−44100/674=2004.54−65.43 Hz

2. Search for $k_{max}=\arg(\max(r_x(k))/_k)$, $k_{max}$ represents k value when $r_x(k)$ is max value
3. Fundamental frequency $f_0=44100/k_{max}$ Then, recorder 4 is used to record the maximum fundamental frequency. The use of the audio recorder 2, audio counter 3 and recorder 4 are repeated until completion of test. Finally, the vocal range estimator 6 (shown in FIG. 2) is used to estimate the suitable maximum audio frequency. If assuming the maximum fundamental frequency is 440 Hz, it is transformed into audio symbol of A4. Assuming the key is male's key, the maximum fundamental frequency is transformed into audio symbol of A5. Assuming that no music training is received, and n2=3, the suitable maximum tone is F#5. The maximum tone of a song shall be tuned for not exceeding F#5.

The audio tuning method of the present invention along with programmed language is used to develop an electronic element and processor that enables recording, storage and calculation through an interface. Also, it can be widely applied to various electronic equipment or musical instruments or Internet, thus forming an audio tuning hardware.

I claim:

1. An audio tuning method comprising:

setting human factors of a testee;

recording a singing of at least a portion of a song by the testee;

calculating an audio frequency of the recording by an audio counter;

recording a fundamental frequency of the calculated audio frequency by a recorder;

estimating an audio frequency range by a vocal range estimator; and transforming the estimated audio frequency range into an optimum audio frequency (X) and a maximum fundamental frequency, the maximum fundamental frequency being X+12 half tones for a man.

2. The method of claim 1, said recorder being a digital audio recorder.

3. The method of claim 1, the human factors being at least a sex of the singer.

4. The method of claim 1, the human factors being at least whether musical training of the singer has occurred.

* * * * *